US005257440A

United States Patent [19]

Bardou et al.

[11] Patent Number: 5,257,440

[45] Date of Patent: Nov. 2, 1993

[54] PORTABLE MODULAR STRUCTURE

[76] Inventors: Christian Bardou, Hameau l'Epinay, F-76690 La Rue Saint Pierre; Philippe Levasseur, 3 Rue de Caen, 76600 Le Havre, both of France

[21] Appl. No.: 884,220

[22] Filed: May 11, 1992

[30] Foreign Application Priority Data

Jul. 7, 1989 [FR] France ..... 8909459

Related U.S. Application Data

[63] Continuation of Ser. No. 638,567, Jan. 7, 1991, abandoned.

[51] Int. Cl.[5] ..... A44B 21/00

[52] U.S. Cl. ..... 24/287; 52/79.1; 52/79.9; 52/280; 52/656.1; 52/656.9; 220/1.5; 410/81; 410/83

[58] Field of Search ..... 52/79.1, 79.9, 234, 52/236.3, 280, 698.1, 656.1, 656.9, 657; 24/287; 220/1.5; 410/78, 81, 83

[56] References Cited

U.S. PATENT DOCUMENTS

| | | | |
|---|---|---|---|
| 1,849,273 | 3/1932 | Broderick | 52/638 |
| 2,997,762 | 8/1961 | Imparato | 24/287 |
| 3,317,219 | 5/1967 | Hindin et al. | 24/287 X |
| 3,556,456 | 1/1971 | Lunde | 24/287 X |
| 3,593,387 | 7/1971 | Georgi | 24/287 X |
| 3,601,866 | 8/1971 | Odin | 410/91 |
| 3,691,595 | 9/1972 | Backleman et al. | 24/287 |
| 3,752,511 | 8/1973 | Racy | 410/82 X |
| 3,818,671 | 6/1974 | Matsushital et al. | 52/638 |
| 3,872,555 | 3/1975 | Link et al. | 403/33 X |
| 4,037,376 | 7/1977 | Baal-Taxa | 52/280 |
| 4,419,034 | 12/1983 | DiMartino | 410/83 |
| 4,505,402 | 3/1985 | Gerhard . | |
| 4,537,540 | 8/1985 | Boughton | 403/348 X |
| 4,599,829 | 7/1986 | DiMartino, Sr. . | |
| 4,626,155 | 12/1986 | Hlinsky et al. | 220/1.5 X |
| 4,653,659 | 3/1987 | Bersani | 220/1.5 |
| 4,828,308 | 4/1989 | Riedl | 410/83 |
| 4,856,150 | 8/1989 | Johnson | 410/83 |
| 4,910,939 | 3/1990 | Cavanagh | 52/648 |
| 4,993,125 | 2/1991 | Capron et al. | 24/287 |

FOREIGN PATENT DOCUMENTS

| | | | |
|---|---|---|---|
| 0215217 | 6/1983 | European Pat. Off. . | |
| 2125180 | 12/1972 | Fed. Rep. of Germany . | |
| 3132837 | 8/1982 | Fed. Rep. of Germany | 52/234 |
| 3208302 | 9/1982 | Fed. Rep. of Germany . | |
| 2649430 | 1/1991 | France . | |

*Primary Examiner*—Carl D. Friedman
*Assistant Examiner*—Robert Canfield
*Attorney, Agent, or Firm*—Burns, Doane, Swecker & Mathis

[57] ABSTRACT

A modular structure comprising a metal frame consisting of tubular elements with rectangular cross sections, welded to each other by means of gusset plates, wherein the tubular elements are interrupted at the point of the juncture of one frame with an adjacent one, the free spaces provided in this manner being occupied by joining pieces.

10 Claims, 7 Drawing Sheets

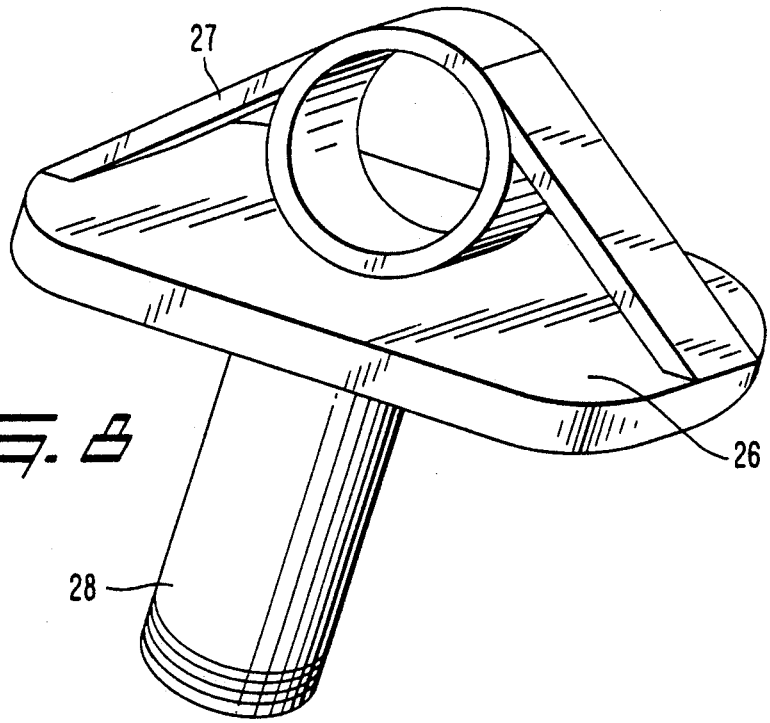
Fig. 8
Fig. 9
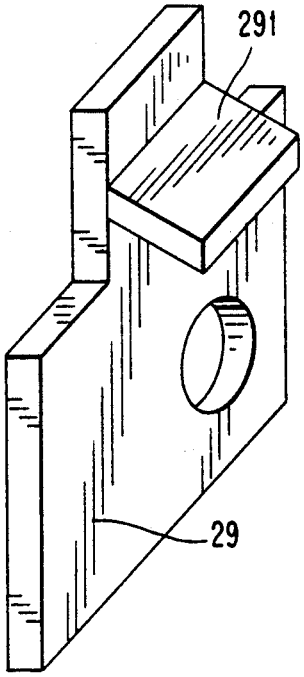
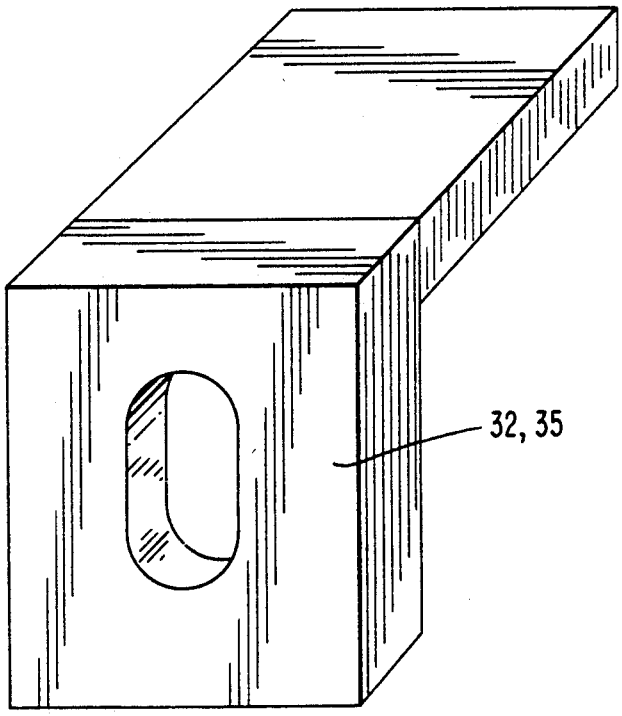
Fig. 10A

Fig. 13
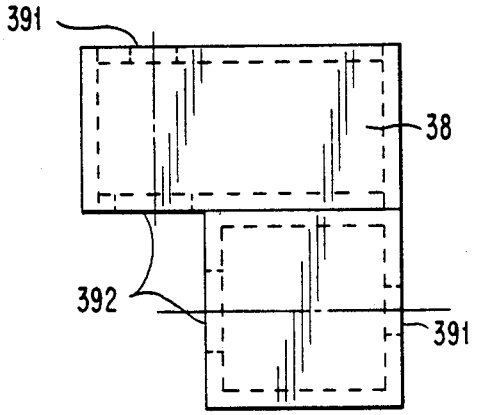
Fig. 10B
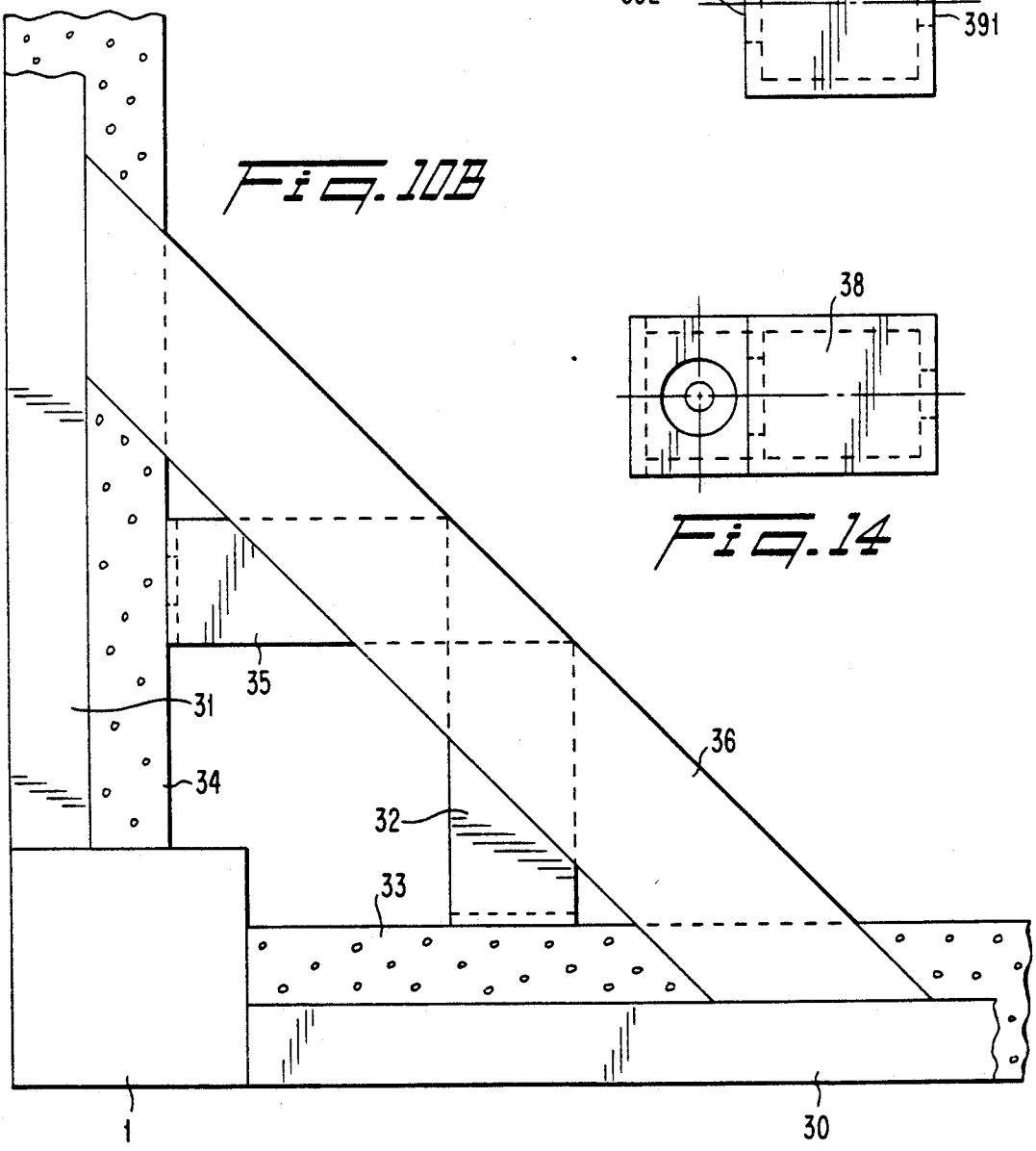
Fig. 14

PORTABLE MODULAR STRUCTURE

This application is a continuation of application Ser. No. 07/638,567, filed Jan. 7, 1991, now abandoned.

BACKGROUND OF THE INVENTION

The invention relates to a modular structure comprising a metal frame for each of the modules, the frame being made of tubular elements welded together, in particular with the insertion of gusset plates.

Prefabricated buildings consisting of parallelepipedic elements are known. In general, these elements are not designed to be portable, except by special transporting means. Furthermore, the existing structures are not readily transported by sea due to lashing problems and their nonstandard dimensions.

It is an object of the present invention to overcome the above disadvantages by providing a modular structure which can be readily transported by train, ship or helicopter and which can be joined together easily and have an exterior appearance extremely similar to a conventional house.

SUMMARY OF THE INVENTION

The modular structure according to the present invention is provided such that the tubular elements are interrupted at the joints of a frame with the contiguous skeleton and the spaces freed in this manner are filled by joining pieces.

One of the essential characteristics of the modules is that they have, in their horizontal projection, the dimensions of a standard container. The height of the parallelepipedic elements is also that of standard containers and if the element is prismatic, with an inclined part forming the roof, the height of the highest part is also that of a container.

To facilitate the mounting of the elements above each other, the lower corners have the characteristics of ISO (International Standard Organization) container corners, with T-shaped pieces screwed into threaded orifices provided inside the corners of the lower containers securing the upper module by their rotation, the module being retained by the ISO corner of the latter. The aforementioned orifices are provided to receive shackles to tie down the modules and in the case of prismatic modules with an inclined roof, similar threaded orifices are provided inside the corners at the bottom of the incline for a single sling. The fastening of the elements above each other is made even more secure by means of pieces in the shape of an inverted L fastened by a screw bolt connection in the free corners of the lower elements and hooked into the ISO corners of the upper element.

The lower modules are mounted on the foundations on metal corner elements screwed to the foundation, with the corner elements being welded to braces provided obliquely to the corners of each lower module.

Finally, the modular construction system makes it possible, if two parallel rows of modules are placed spaced apart from each other, to join them together by means of trusses to form a large room, or if poles are placed between the two rows, to join the tops of the poles and the top of the modules by bracing wires, the whole being covered by a sheet, again to form a large room. In these two cases, the joints of the trusses or bracing wires are threaded orifices placed at the corners of the modules, by screwing in the case of metal trusses or by means of shackles in the case of bracing wires.

BRIEF DESCRIPTION OF THE DRAWINGS

The invention will now be described in greater detail with reference to preferred embodiments given solely by way of example and illustrated in the accompanying drawings, in which:

FIGS. 8 and 9 show connecting elements in the shape of a T and an inverted L to insure the fastening of one module on the other;

FIG. 10A shows an angle used in the securing of a modular element to its foundation;

FIG. 10B shows the corner of a lower module and its fastening to the foundations;

FIG. 13 shows a side view of a connecting piece used in the connection of FIG. 11;

FIG. 14 shows a top view of the connecting piece of FIG. 13;

DETAILED DESCRIPTION OF THE PREFERRED EMBODIMENTS

Figure 1:
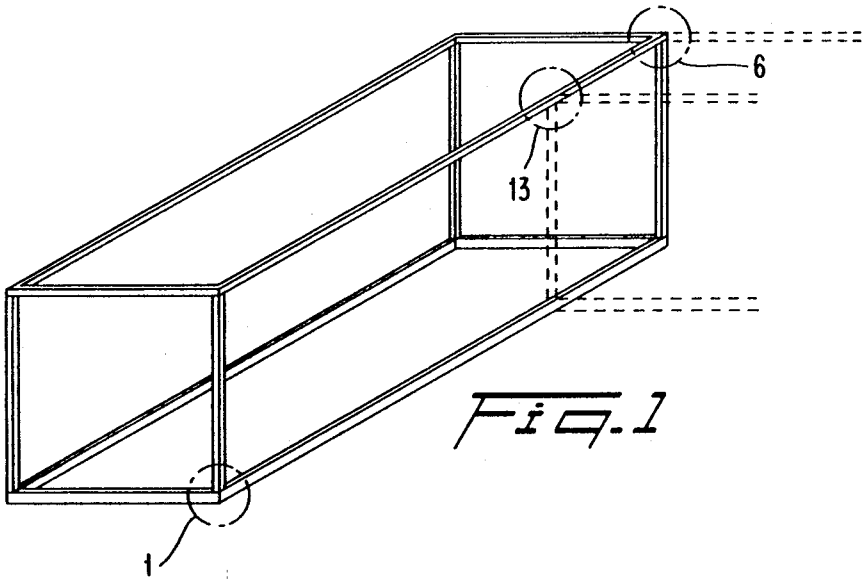
FIG. 1 is a perspective view of the frame of a module.
Figure 2:
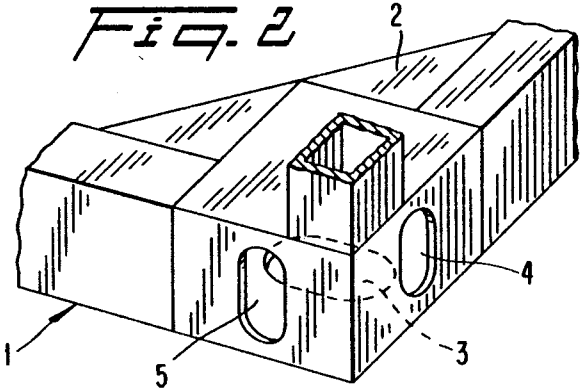
FIG. 2 is an enlarged perspective view of a lower corner of a module of FIG. 1.
Figure 3:
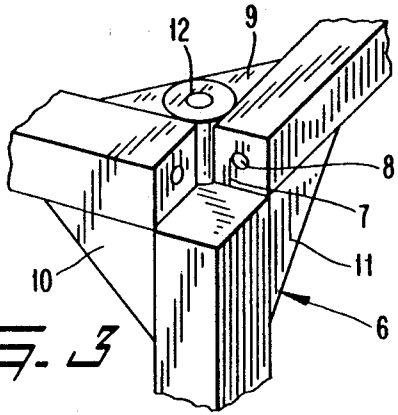
FIGS. 3 and 4 show enlarged views of interrupted parts of the tubular elements at the corners and the linear part of the frames, respectively.

The frame shown in FIG. 1 has the external dimensions of a 40 feet container, the size of one type of standard building container used to transport modular elements. One of the corners 1, shown in enlarged view in FIG. 2, is inserted at a location where the tubular elements constituting the frame are interrupted, the continuity being insured by an insert 2. The corner 1 in question is a piece similar to an ISO corner of a container, comprising elongated holes 3, 4 and 5, which make possible the connections to be described below. FIG. 3 shows an enlarged view of the upper corner 6 of a frame. At this location, the tubular elements of the frame are again interrupted and closed off by plates 7 perforated by a threaded hole 8. A gusset plate 9 connects the upper, horizontal elements of the frame with each other and the gusset plates 10 and 11 connect the horizontal elements with the corresponding sides of the vertical elements of the frame as clearly seen in FIG. 3.

Figure 4:
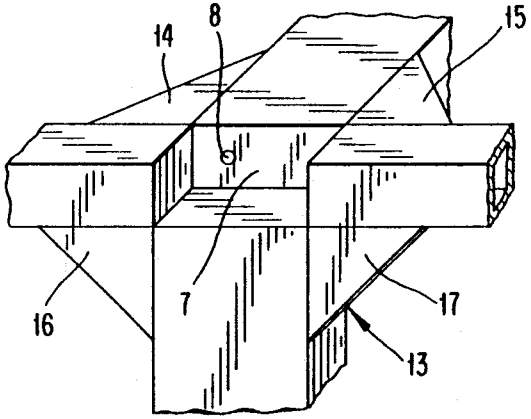

The gusset plate 9 further comprises a threaded orifice 12. The threaded orifice 12 can be used to attach shackles to tie down the element and to connect the element to an upper module. FIG. 4 shows the location 13 in an upper horizontal tubular element, where a perpendicular element, shown schematically by broken lines in FIG. 1, can be attached, at which location the horizontal tubular elements are interrupted and the gusset plates 14, 15, 16 and 17 insure the joining of the elements with each other. The tubular elements are closed off by plates 7 perforated by threaded holes such as 8, which are used in the assembly operation. The free site or opening defined at the location 13 by the interrupted tubular elements will be used to locate a joining piece, as shown below.

Figure 6:
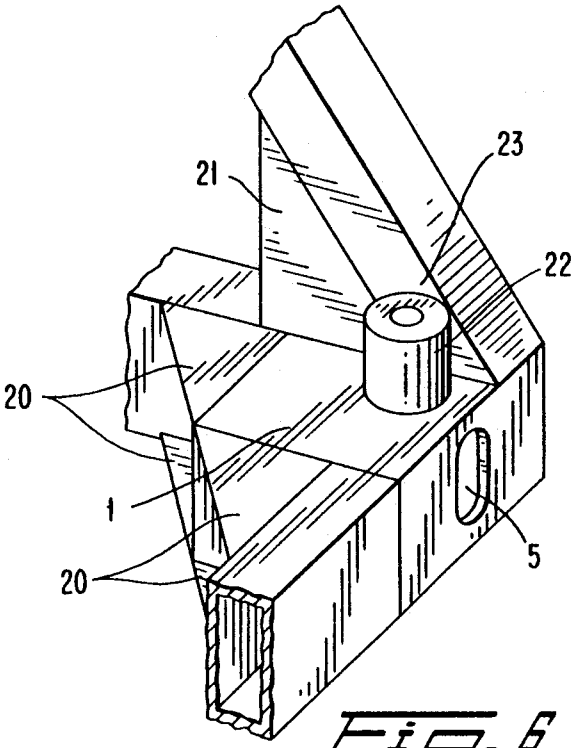
FIG. 6 shows an exploded view of a lower corner of the module of FIG. 5.
Figure 5:
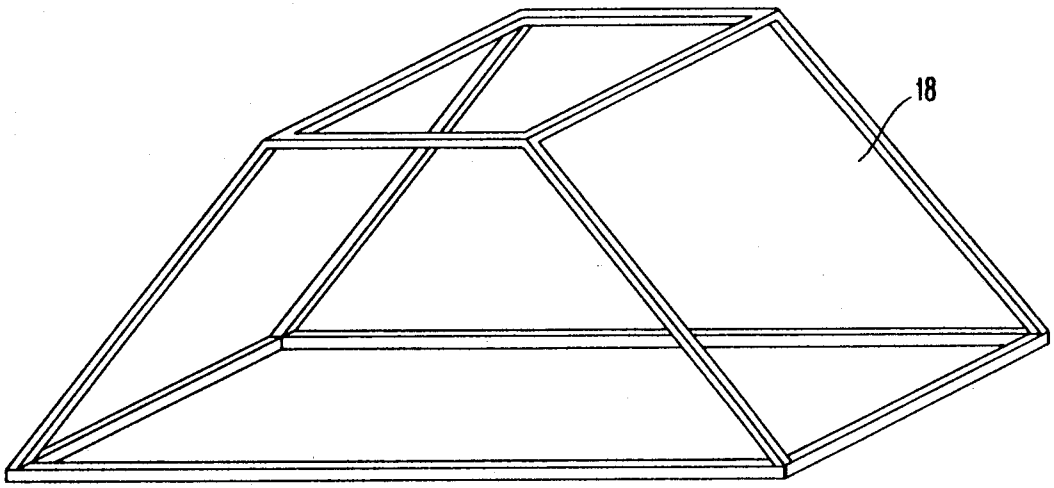
FIG. 5 shows the frame of a prismatic module.
Figure 7:
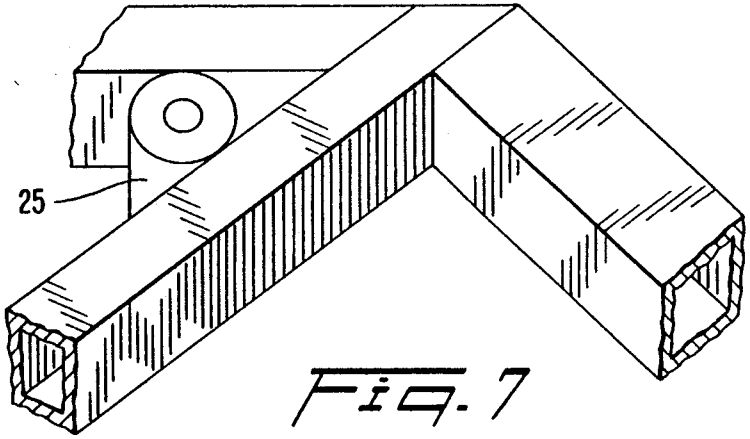
FIG. 7 shows an exploded view of an upper corner of the module of FIG. 5.

FIG. 5 shows a prismatic module 18 with dimensions in its horizontal projection of a 40 feet container, the lower corners of which are shown in FIG. 6 and the upper V-shaped parts of which are shown in FIG. 7. At the lower corners, all of the tubular elements are interrupted and replaced by a piece similar to an ISO corner 1 of the container shown in FIG. 6, with the gusset plates 20 and 21 assuring continuity. The element 1 further carries a cylinder 22 containing a threaded orifice 23 to allow shackles to be attached for handling the module 18. Similar cylinders 25, shown in FIG. 7, are provided for the same reason at the upper corners of the prismatic element 18.

Figure 16:
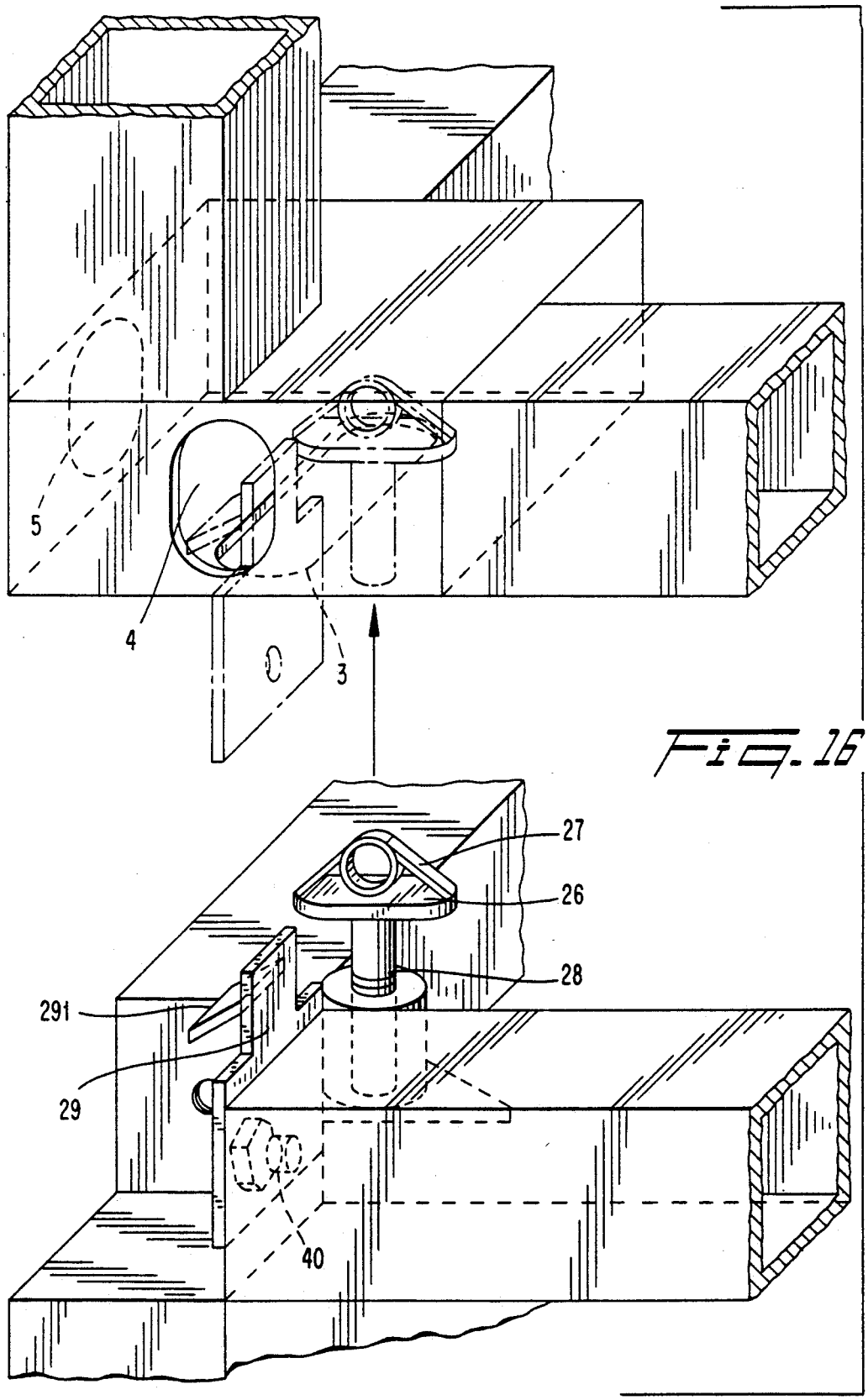
FIG. 16 is an exploded view illustrating lower and upper corners being fastened together.

FIG. 8 shows a fastening element 26 for use between a lower module and an upper module. This element 26 has an element 27 which form the top of a T, and a round, threaded bolt 28. The latter can be screwed into threaded holes, such as 12 (FIG. 3). When the upper module is in place, so that the T 27 is inserted through elongated hole 3 of the ISO corner, such as 1 (FIG. 2), it is sufficient to rotate the T 27 so that the T 27 cannot be pulled out of the holes 3, 4 and 5, in order to secure the assembly. Pieces such as 29 in the shape of an inverted L (FIG. 9), having a part 291 are then screwed at the holes 8 (FIG. 3) by a bolt 40 (FIG. 16) after the part 291 is engaged inside the ISO corner 1 (FIG. 2) to insure the strength of the assembly. These structural engagements are diagrammatically shown in FIG. 16.

FIG. 10B shows how a modular element is secured on its foundation. Hollow, perpendicular profiles 30 and 31 framing the ISO corner 1, are placed on a concrete foundation 33 and 34, into which two steel angles 32 and 35 are inserted. A brace 36 welded to the profiles 30 and 31, is then welded to the angles 32 and 35 (shown in FIG. 10A), thereby assuring the strength of the connection with the foundation in case of a storm.

Figure 11:
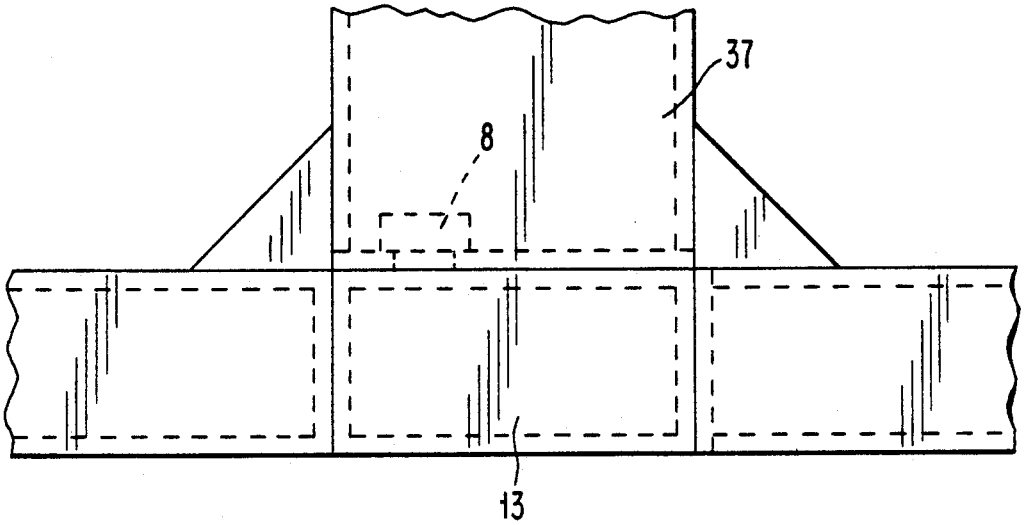
FIG. 11 shows a top view of the connection of a perpendicular, tubular element generally indicated by dotted lines in FIG. 1.
Figure 12:
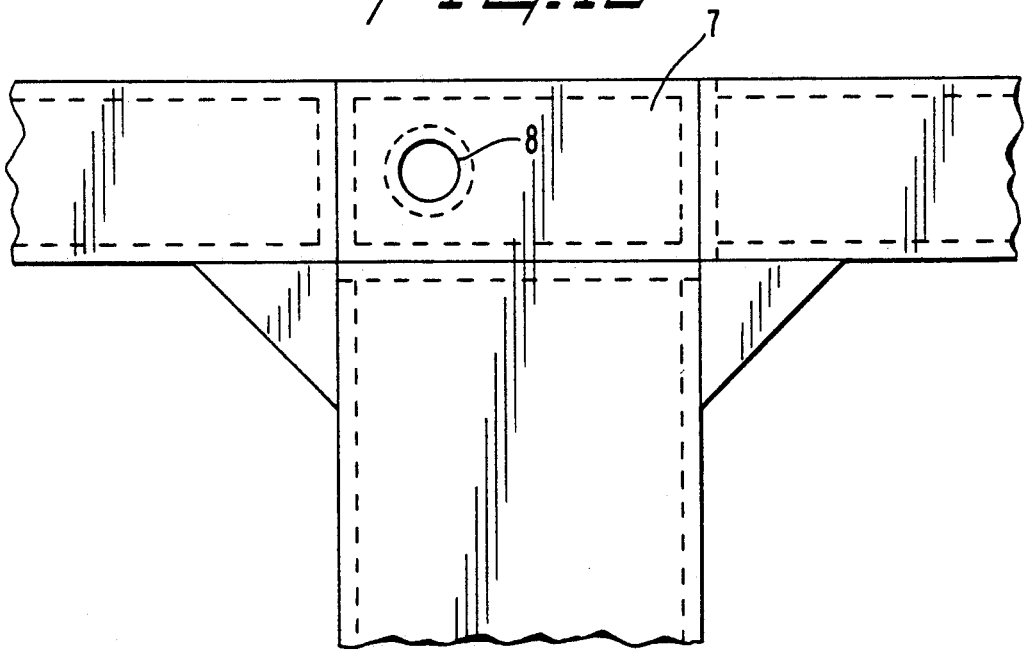
FIG. 12 shows a side view of the connection of FIG. 11.

The upper part of a module comprising an opening such as 13 (FIGS. 1 and 4) is shown in a plane projection in FIG. 11 and a front elevation in FIG. 12. A threaded orifice 8 is provided in the piece 7, which closes the tubular element 37 located perpendicular to the side of the module (see FIGS. 3 and 11). A piece 38, shown in a plane projection in FIG. 13 and a front elevation in FIG. 14, has passage holes 391 and 392 to receive a threaded bolt and its head to secure the joining piece 38 to the module having the opening 13 and to a module perpendicular thereto. It is possible in a similar manner to connect two adjacent modules to form an extension of one another by their upper parts, in which case the joining piece is parallelepipedic.

Figure 15:
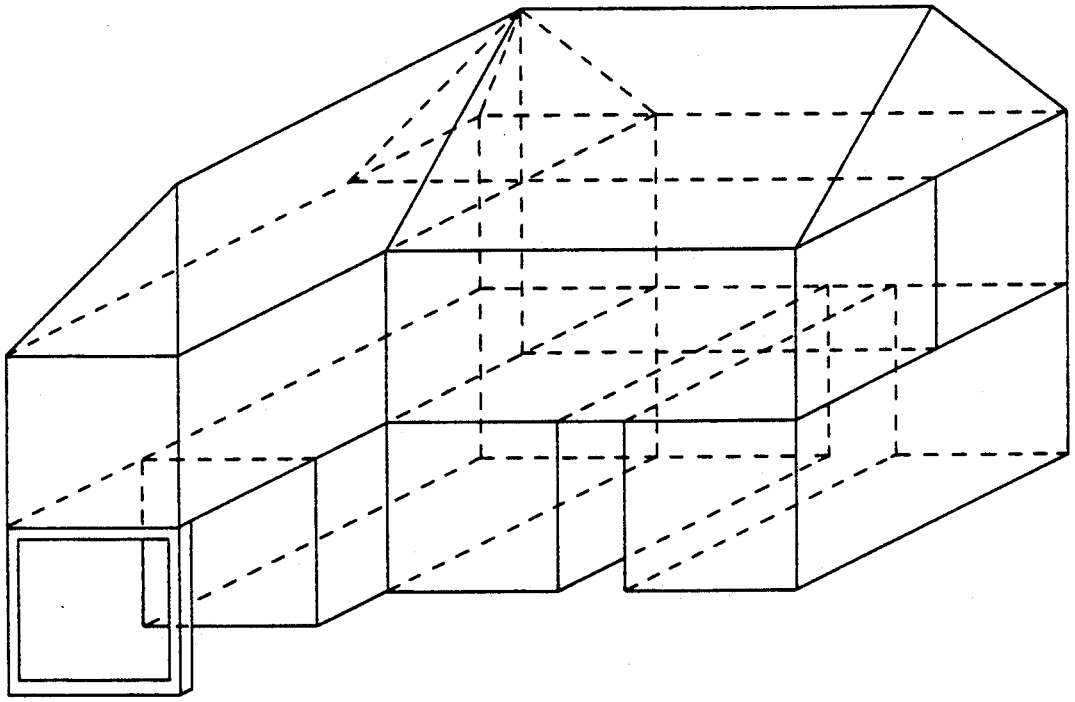
FIG. 15 shows an example of a structure made possible by the present invention.

FIG. 15 shows a complete building erected by the assembly of different modules. It comprises modules with the dimensions of 20 and 40 feet containers and in their upper parts, prismatic modules. The facings, floors and partitions are also prefabricated and assembled by screwing into the orifices tapped into the tubular elements serving as the frame of the modules. It is seen that the appearance of the finished assembly is similar to that of a conventional house. On the other hand, it is readily apparent that each modular element may be easily transported by ship, railroad or road transportation and if necessary, by helicopter.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology of terminology employed herein is for the purpose of description and not of limitation.

What is claimed:

1. A module for use in a modular structure comprising:

a plurality of tubular elements which meet to form a plurality of upper and lower corner regions;

a plurality of connecting pieces each having a flanged end and a straight end;

wherein each of said upper corner regions comprise means for attaching the straight end of one of said connecting pieces thereto;

a plurality of hooking elements;

wherein each of said upper corner regions further comprise means for attaching two of said plurality of hooking elements thereto; and wherein each of said lower corner regions comprise an elongated opening for inserting the flanged end of one of said connecting pieces therethrough.

2. A module as set forth in claim 1 further comprising:

a plurality of gusset plates welded between pairs of said tubular elements at said upper and lower corner regions.

3. A module as set forth in claim 2 wherein each of said upper and lower corner regions include ends of two horizontal tubular members and one vertical tubular member and said means for attaching said connecting pieces are located on a gusset plate between said horizontal tubular members of each of said upper corner regions.

4. A module as set forth in claim 1, wherein each of said upper and lower corner regions include ends of two horizontal tubular members and one vertical tubular member and said means for attaching said plurality of hooking elements comprise bolt holes disposed on end surfaces of said two horizontal members.

5. A module as set forth in claim 1 further comprising:

means for connecting one of said tubular elements to another tubular element extending perpendicular thereto.

6. A module as set forth in claim 5 wherein said means for connecting is a right angle element having two arms and a bolt hole in each arm.

7. A module as set forth in claim 1 further comprising:

means for attaching shackles to said module.

8. A module as set forth in claim 1 wherein said lower corner regions further comprise two additional openings for permitting access to said elongated opening.

9. A module as set forth in claim 1 further comprising a plurality of braces between tubular elements for attaching said module to a foundation.

10. A plurality of adjacent modules for use in a modular structure:

each module comprising a plurality of tubular elements which meet to form a plurality of upper and lower corner regions;

a plurality of hooking elements;

wherein said hooking elements each comprise a first plate having a bolt hole therethrough and a second plate attached to the first plate and extending therefrom at an acute angle;

wherein said upper corner regions each comprise means for attaching a plurality of said hooking elements thereto; and wherein each of said lower corner regions comprise an elongated opening whereby said hooking elements can be inserted through said elongated opening and engage a surface surrounding said elongated opening to secure said lower corner regions to adjacent upper corner regions.

* * * * *